United States Patent [19]

Machon, Sr.

[11] Patent Number: 4,515,398

[45] Date of Patent: May 7, 1985

[54] DEVICE FOR ELEVATING CLOSET BOWL

[76] Inventor: William P. Machon, Sr., 95 Walnut Rd., Barrington, R.I. 02806

[21] Appl. No.: 472,484

[22] Filed: Mar. 7, 1983

[51] Int. Cl.[3] ..... F16L 55/00

[52] U.S. Cl. ..... 285/59; 285/12

[58] Field of Search ..... 285/56, 58, 59, 60, 285/57, 12; 4/252 R

[56] References Cited

U.S. PATENT DOCUMENTS

| | | | |
|---|---|---|---|
| 711,946 | 10/1902 | Day | 285/58 |
| 718,444 | 1/1903 | Fleming | 285/58 |
| 845,534 | 2/1907 | Delanoy | 285/58 X |
| 1,533,444 | 4/1925 | Mohr | 285/58 X |
| 1,878,195 | 9/1932 | Sisk | 285/58 |
| 2,673,985 | 4/1954 | Gay | 285/56 X |
| 3,893,510 | 7/1975 | O'Connell | 4/252 R |

*Primary Examiner*—Dave W. Arola

*Attorney, Agent, or Firm*—Barlow & Barlow

[57] ABSTRACT

An elevating device for a toilet closet bowl is disclosed in which an extender pipe having upper and lower flanges is provided, along with a support platform that embraces the extender pipe and onto which the lower rim of the toilet bowl may rest.

7 Claims, 2 Drawing Figures

DEVICE FOR ELEVATING CLOSET BOWL

BACKGROUND OF THE INVENTION

This invention relates in general to a toilet closet bowl, and more particularly to apparatus for elevating the bowl above an existing floor flange. In general, existing toilet closet bowls are of a fixed height and are supplied in a low version and a higher version, the higher version being utilized by handicapped persons who, because of an infirmity, may not be able to seat themselves on a regular sized closet bowl. In the past it has been necessary to purchase a second bowl with a higher casting and discard the installed bowl. The only attempts that have been made to adapt this situation have been in public convenience rooms where the two differently sized bowls have been installed. In a private residence, however, it is impossible to install a plurality of bowls, and it is not practical from an expense standpoint to install an adjustable toilet, such as suggested by the disclosure in U.S. Pat. No. 4,091,473.

SUMMARY OF THE INVENTION

The present invention relates to a toilet closet bowl device that will elevate the bowl above an existing floor level in a simple straight forward manner, so that an existing toilet bowl may be raised to enable a handicapped person to use the same with minimal cost.

The device for elevating a toilet closet bowl in accordance with the present invention includes an extender pipe with upper and lower flanges that is adapted to be coupled directly to an existing floor flange, together with a support means that embraces the extender pipe, the support means being of a size to allow the bearing rim of a closet bowl to rest thereon. The extender pipe will have usual gasket means between the existing floor flange, as well as between the extender pipe and the closet bowl, and the extender pipe may be bolted to the floor flange by using existing flange bolts and the closet bowl may then be coupled to the upper flange of the extender pipe by another set of bolts or studs.

DESCRIPTION OF THE PREFERRED EMBODIMENT

Figure 1:
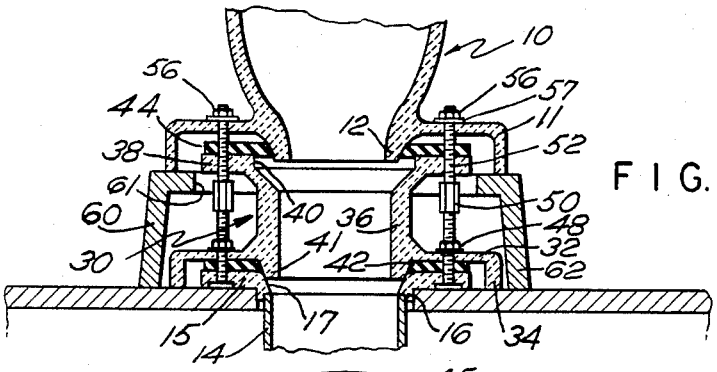
FIG. 1 is a lateral sectional view with an installed closet bowl and elevating device in accordance with the invention.
Figure 2:
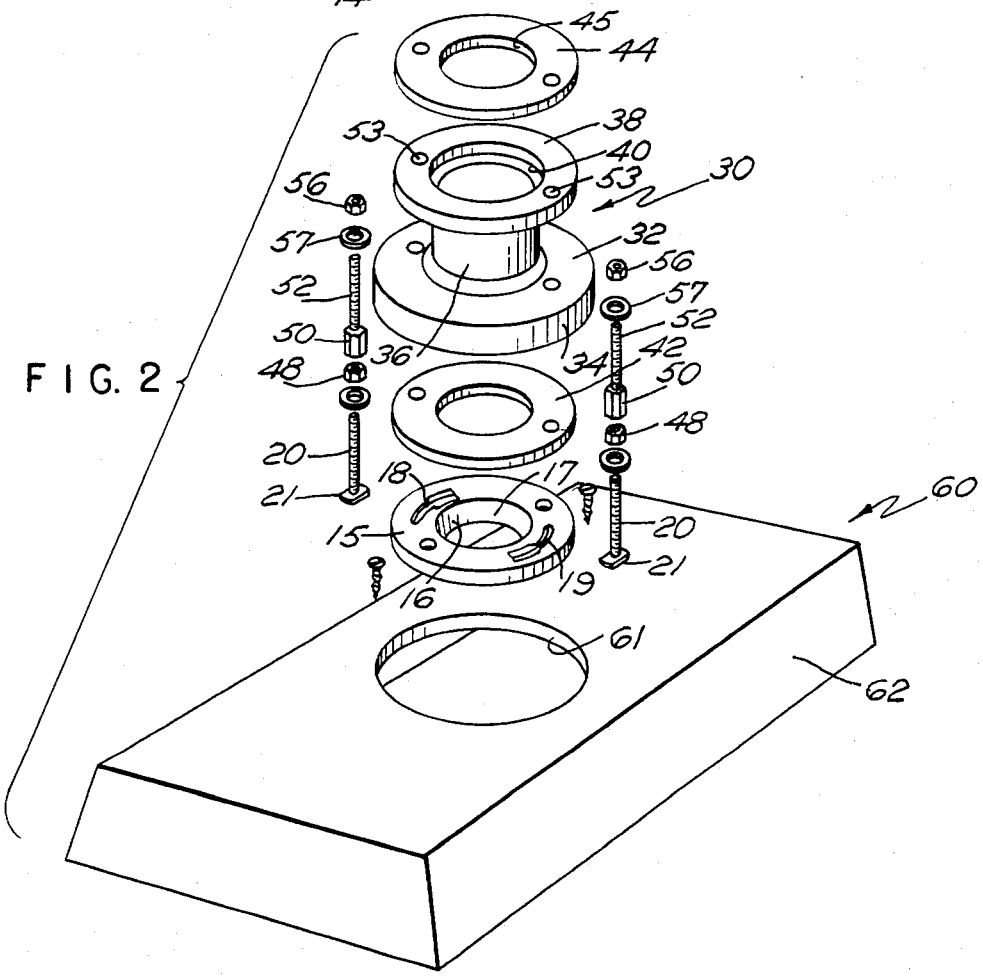
FIG. 2 is an exploded view of the elevating device and the parts associated therewith.

In reference to the drawings, the toilet closet bowl is generally designated 10 and includes a base flange 11 and a spigot portion 12 through which waste may be discharged into a soil pipe such as 14. It is common in the United States today to have a floor flange coupled to the soil pipe. In this instance there is shown a usual floor flange 15 which has a cylindrical part 16 with an inwardly tapered wall as at 17 to receive the spigot 12 of the closet bowl. In addition, the floor flange is arranged in such a way, particularly if it is made of plastics, such that a counter bore is provided to receive the soil pipe 14. The flange is also provided with arcuate, diametral opposed slots 18 and 19, each with an enlarged portion so as to receive studs such as 20 that are provided with T-heads 21 that will pass through the enlarged portion of the slot and be slid over to a proper position for further use. As will be understood, in installing a toilet closet bowl, the studs such as 20 will extend upwardly from the slots such as 18 and 19 through apertures in the flange 11 of the toilet closet, and the closet is rotated until it is in proper position, and then nuts are tightened to hold the closet in position and to squeeze the horn spigot 12 against suitable gasketing means.

The elevating device comtemplates removing an installed closet bowl, which would be installed as for example, as seen in U.S. Pat. No. 2,082,348, and to provide further elevation to utilize an extender pipe generally designated 30, which extender pipe comprises a radially extending lower flange 32 that has a downwardly extending lip 34. The flange is made integral preferably with the cylindrical pipe section 36 which terminates in an upper flange 38. By referring to FIG. 1, the inner portion of the upper flange where it joins to the pipe is recessed as at 40 to receive the spigot or horn 12 of the closet bowl. To provide adequate sealing at the lower portion of the extender pipe, there is formed as an extension thereto below the lower surface of the radially extending flange, a spigot 41 which has its outer surface tapered. To complete the installation, circular gaskets such as 42 may lie between the bottom face of the radially extending lower flange and the existing floor flange, and will be provided with an inner portion that will nest within the recessed and tapered section 17 of the floor flange and about the outer tapered portion of the spigot 41. In assembly the inner portion of gasket 44 becomes tapered as at 45 as it snugly fits between the upper flange 38 and the outer portion of the spigot or horn 12.

In installing the extender, the extender pipe and the gaskets are assembled by having the studs 20 extend up through the extender pipe and nuts such as 48 be provided to tighten the extender pipe into position by utilizing the existing studs. In this instance a coupling nut 50 can be placed on the existing studs, and the studs may then have an extender portion 52 screwed therein that will pass on up through the upper flange apertures as at 53 and through the gasket apertures. The toilet bowl will now be placed in position after a base 60 with its aperture 61 is placed about the extender pipe.

After the parts have thus been assembled with the support means 60 that has depending peripheral flanges such as 62 thereabout, the assembly can be tightened down so that the gaskets will be tightly engaged by tightening down the nuts 56 that lie on washers 57 and engage the top surface of the closet bowl base. It will be apparent that long studs with T-heads may be also utilized in lieu of using the coupling nuts 50 and an extender studs 52; and in this case, the initial studs that pass through the existing floor flange will be of a sufficient length to allow passage into the apertures on the base of the closet bowl and have nuts tighten the assembly down, which in effect will squeeze the gaskets 44 and 42 in position and provide a good tight seal. Typically, the gaskets are made of a sponge rubber material which is resilient and will normally maintain its resilience for a long period of time so that it maintains a tight joint despite any attempt or subsequent shifting of the bowl with respect to the soil pipe as might occur due to settling of floor structures and the like.

I claim:

1. A toilet closet bowl device for elevating the bowl above an existing floor flange having upstanding studs, comprising an extender pipe with upper and lower ends having upper and lower flanges extending radially outward and fixed thereto at each end thereof, said lower flange engaging the existing floor flange, a support means embracing the extender pipe and the lower and floor flanges, said support means having an upper surface of a size to allow the bearing rim of a closet bowl to rest thereon, said upper surface of the support means having a height above the floor flange whereby the upper flange of the extender pipe lies above the upper surface thereof.

2. A toilet closet bowl device as in claim 1 wherein there are gasket means between the lower flange and the floor flange.

3. A toilet closet bowl device as in claim 1 wherein there are gasket means between the upper flange and the upper flange and the closet bowl.

4. A toilet closet bowl device as in claim 1 wherein a lip extends downwardly from the lower flange.

5. A toilet closet bowl device as in claim 1 wherein a lip extends downwardly from the lower flange and the pipe extends downwardly from the lower flange substantially the axial extent of said lip.

6. A toilet closet bowl device for elevating the bowl above an existing floor flange having upstanding studs, comprising an extender pipe having radially extending lower flange with a peripheral downwardly extending lip, said lip encircling the floor flange, gasket means between the floor flange and the lower flange, an upper flange on said pipe, said upper flange being centrally recessed to receive the spigot of a closet bowl, gasket means lying on said upper flange and aligned apertures in said lower and upper flanges to receive the upstanding studs extending from the floor flange upwardly to the closet bowl and support means about the extender pipe to engage and support the base of the closet bowl.

7. A toilet closet bowl as in claim 6 wherein said upper and lower flanges are integral with said extender pipe.

* * * * *